United States Patent [19]

Ruegger

[11] 4,033,388

[45] July 5, 1977

[54] BENDING AND CUTTING TOOL

[75] Inventor: Richard A. Ruegger, San Diego, Calif.

[73] Assignee: The United States of America as represented by the Secretary of the Navy, Washington, D.C.

[22] Filed: May 3, 1976

[21] Appl. No.: 682,693

[52] U.S. Cl. ..... 140/106; 72/294; 72/331; 72/DIG. 10

[51] Int. Cl.[2] ..... B21F 1/00

[58] Field of Search ..... 72/294, 331, 332, DIG. 10; 140/1, 105, 106; 113/119

[56] References Cited

UNITED STATES PATENTS

| | | | |
|---|---|---|---|
| 2,217,486 | 10/1940 | Larjon | 72/231 |
| 3,146,804 | 9/1964 | Wallshein | 140/106 |
| 3,796,201 | 3/1974 | Golub | 140/105 |

*Primary Examiner*—Lowell A. Larson
*Attorney, Agent, or Firm*—R. S. Sciascia; G. J. Rubens

[57] ABSTRACT

A portable scissor-like tool is provided that will bend and cut a workpiece at a predetermined length, such as the electrical leads extending from a flat-pack type of integrated module in sequential operations without the need for changing tools. Adjustable means are provided for varying the depth of the bend in the workpiece depending on the installation. Latch means are included to prevent the accidental cutting of the leads before the bending operation.

4 Claims, 9 Drawing Figures

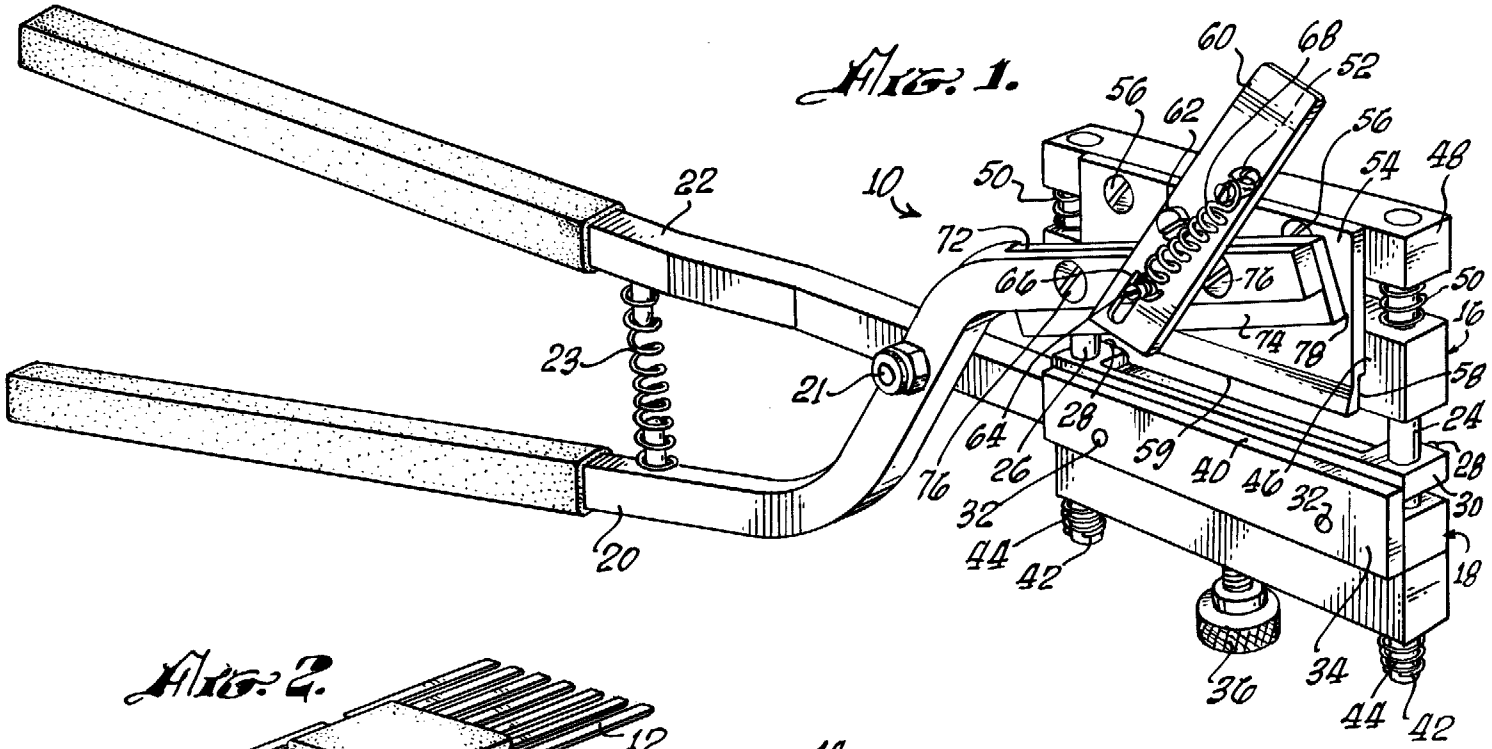
Fig. 1.
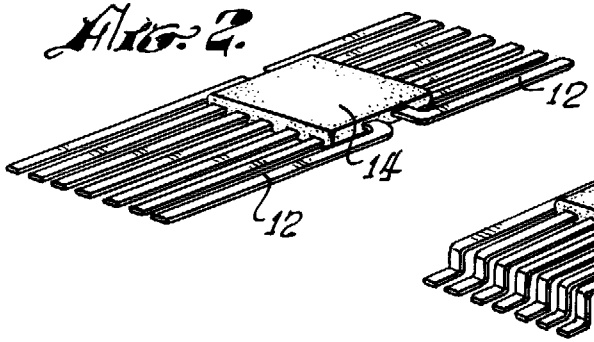
Fig. 3.
Fig. 2.

BENDING AND CUTTING TOOL

BACKGROUND OF THE INVENTION

Miniature and micro-miniature electronic circuit boards use various integrated circuit modules connected thereto by electrical leads, such as so-called flat-packs. These components vary greatly in size, length, and number of extending leads. The components are usually manufactured with straight leads having a length that will satisfy all known installations. Accordingly, the leads must be tailored to any specific board in the size of their offset bend, and the length of their leads.

Bench-type hand presses are available in the micro circuitry industry for the bending and cutting operation of flat-pack type leads, requiring special dies for each type and size of component to be tailored. Such machines are large, costly, and not readily portable.

SUMMARY OF THE INVENTION

A scissor-like tool is provided for performing in sequential operations the functions of gripping, bending, and cutting a workpiece, such as the electrical leads extending from a flat-pack type of module.

The tool comprises a pair of jaws, at least one of which is movable with respect to the other, each jaw being provided with a handle. As the jaws are sufficiently wide to handle a wide range of module sizes, means are provided for aligning said jaws during their sequential movements. The movable jaw has a spring loaded clamping bar for gripping the article to be bent against mating clamping bar on the other jaw. The clamping bar is driven by an actuating bar which in turn is moved by its respective handle through a pivotally mounted releasable link. Mounted on the actuating bar is a bending bar which bends that portion of the article protruding beyond the clamping bars and against an anvil mounted on the other jaw. When the link is released, further squeezing of the handles enables a cutting bar to trim off any access of the article extending beyond the bend created by the bending bar.

STATEMENT OF THE OBJECTS OF THE INVENTION

A principal object of this invention is to provide a scissor-like portable tool that will both bend and cut an article in sequential operations without changing tools.

Other objects, advantages and novel features of the invention will become apparent from the following detailed description of the invention when considered in conjunction with the accompanying drawings.

BRIEF DESCRIPTION OF THE DRAWINGS

FIG. 1 is a perspective view of the novel tool showing the jaws in a normally relaxed open position.

FIG. 2 is a perspective view of the electronic flat-pack module prior to being worked by the novel tool.

FIG. 3 is a similar view of the module of FIG. 2 after the leads have been bent and trimmed by the novel tool.

DESCRIPTION OF THE PREFERRED EMBODIMENT

Figure 4:
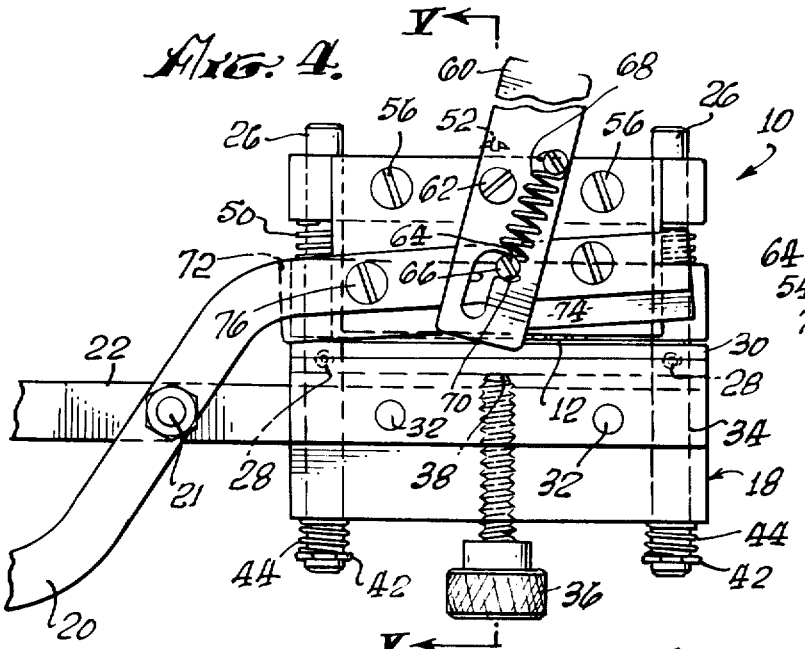
FIGS. 4 and 5 are a side elevation view such as cross-sectional view taken along line V—V of FIG. 4, respectively, of the tool with the jaws initially closed to clamp the electrical lead wires of the module of FIG. 2, illustrating the first step in the tool operation.

Referring to the drawing where like reference numerals refer to similar parts throughout the drawings, there is shown in FIG. 1 a novel scissor-like tool 10 capable of sequentially clamping, bending and trimming an article, such as the leads 12 of a flat-pack type of electronic module 14 (see FIGS. 2 and 3).

Tool 10 includes a pair of jaws 16 and 18 which generally may be referred to as upper and lower jaws assemblies, respectively, having handle portions 20 and 22, respectively, intermediately pivoted at 21. The jaws are biased to an open position in FIG. 1 by a coiled compression spring 23 positioned between the handles. Jaws 16 and 18 have a sufficient length, i.e., approximately two inches, to accommodate modules of different dimensions. Because of the length of the jaws, means are provided for maintaining the jaw in alignment during their opening and closing movements, which in the illustrated embodiment comprises a pair of spaced apart pins 24 and 26 that extend between the jaws. The pins are secured by set screws 28 (FIG. 4) to a lower clamping bar 30 of jaw 18 and extend freely through drilled openings in the remaining components of bottom jaw 18 and all of the components of upper jaw 16. Lower clamping bar 30 is recessed at 31 for a purpose to be described.

The jaw end of handle 22 is bolted at 32 to a lower bending bar 34 assembly which is movable on pins 24 and 26 with respect to lower clamping bar 30 by centrally positioned knurled adjusting screw 36 threaded through the lower jaw and abutting on the bottom of the lower clamping jaw at 38. This adjustment enables the depth of step 40 (FIG. 3) in the electrical leads to be varied in accordance with the thickness of the module and the requirements of any specific installation. The lower ends of each pin 24 and 26 is provided with a detachable split locking washer 42, and a compression coil spring 44 positioned between the washer and the bottom of lower jaw 18 provides a spring bias for adjustment screw 36.

Upper jaw assembly 16 includes an upper clamping bar 46 freely slidable on pins 24 and 26 and movable against lower clamping bar 30 by means of an actuating bar 48 via a set of coil springs 50 one mounted on each pin. Upper clamping is recessed at 49 to face recess 31 in lower clamping bar 30. Clamping bar 46 and actuating bar 50 are adjustably connected together by a centrally positioned bolt 52 threadedly anchored in upper clamping bar 46 and freely movable through actuating bar 48 which allows adjustment of the position of upper clamping bar 46. The resilient connection allows actuating bar 48 to be further depressed independently and relative to upper clamping bar 46 during the bending operation to be described.

Figure 7:
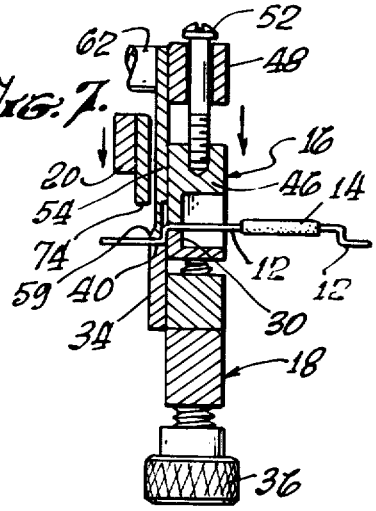
Figure 8:
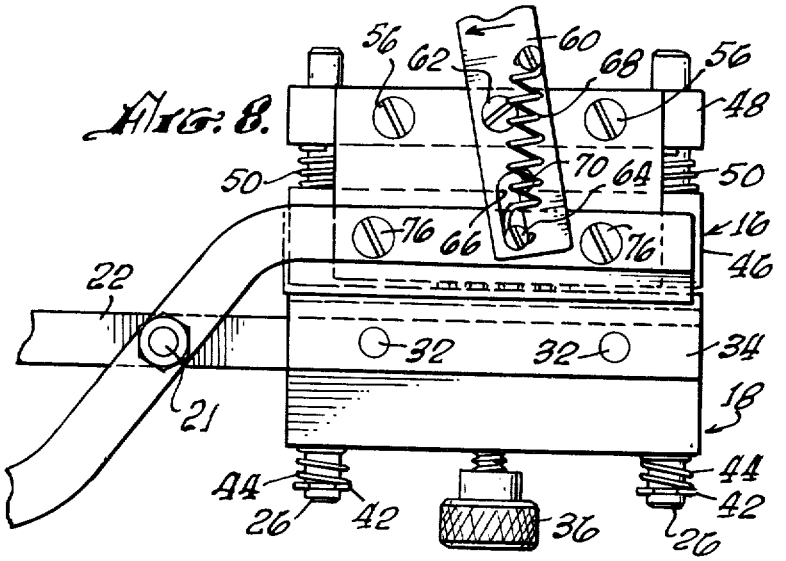
FIGS. 8 and 9 are similar views showing the latch manually released by the operator to enable the handles of the tool to be finally squeezed together for the cutting member to cut off the excess portions of the electrical leads, illustrating the third and final step of the tool operation.

An upper bending bar 54 is secured to actuating bar 48 by a set of screws 56 on the same side of the tool as lower bending bar 34 with which it cooperates during the bending operation, the inner face of bar 54 being recessed at 58 to accommodate the thickness of electrical leads 12 during bending (See FIG. 7). The side of upper bending bar 54, opposite recess 58, has a flared bending edge at 59 for a purpose to be described during the cutting operation. As shown in FIG. 4, the upper clamping bar 46 is adjusted to extend below bending edge 59 so that the leads 12 are firmly clamped before the bending operation is commenced. Upper bending bar 54 is slidable with respect to upper clamping bar 46 to enable the bending operation to proceed after the leads 12 and clamped in position.

Handle 20 is operatively connected to upper jaw 16 through a latch 60 pivotally mounted on a pin 62 which extends through actuating bar 48 and upper bending bar 54. A pin 64 mounted on the jaw end of handle 20 rides in a longitudinal slot 66 formed in link 60, the pin being biased by a tension spring 68 into a right angle locking slot portion 70. The operation of latch 60 is described below.

The inner side of the jaw end of handle 20 is recessed at 72 to receive a cutting bar 74 mounted thereto by screws 76. The inner edge 78 of the cutting bar slides upper bending bar 54 and forms with the flared edge 59 a pair of cutting edges. However, before the cutting bar can be operated, latch 60 must be moved by the operator to cam pin 64 out of locking slot 70 and into slot 66. Spring 68 returns pin 64 back to locking slot 70 after the cutting operation and the handles are relaxed by the operator.

Figure 5:
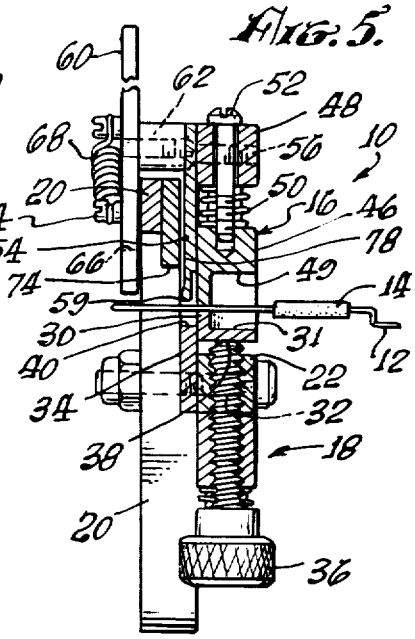

The operation of novel tool 10 is described as follows. With the jaws maintained in a normally open position by compression spring 23 acting on handles 20 and 22 (FIG. 1), flat-pack 14 is positioned by one hand of the operator adjacent the tool with the electrical leads 12 projecting through the opened jaws. The operator then initially compresses the handles together with the other hand causing upper actuating bar 48 through springs 50 to force upper clamping bars 46 against lower clamping bar 30 to clamp leads 12 at their predetermined length, as in FIGS. 4 and 5. Recesses 49 and 31 in the respective clamping bars house the flat-packs to enable short leads to be cut. At this time the relative position of lower clamping bar 30 and lower bending bar 34 is adjusted by screw 36 to provide the proper depth of step 40 in the leads.

Figure 6:
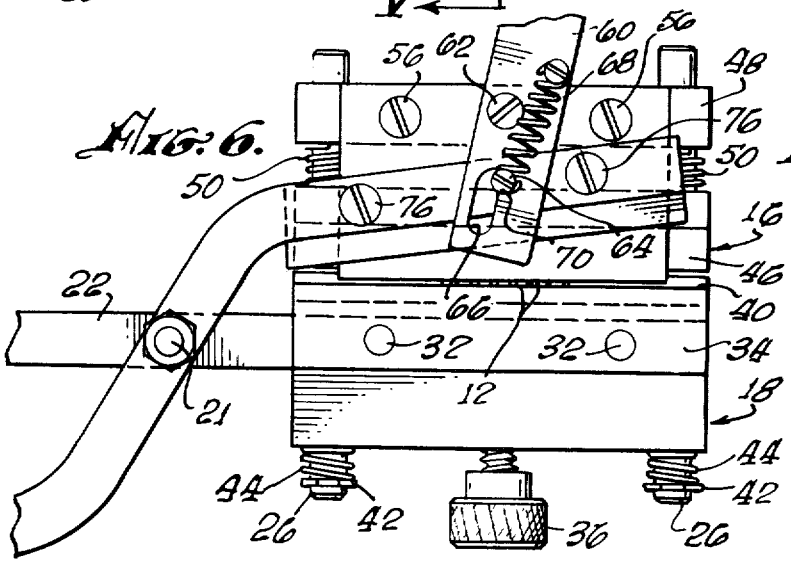
FIGS. 6 and 7 are similar views of the tool with the handles of the tool further squeezed together causing the upper bending member to form a step bend in the electrical leads of the module, illustrating the second step of the tool operation.

Further squeezing together of handles 20 and 22, as in FIGS. 6 and 7, causes actuating bar 48 to move down relative to upper clamping bar 46 further compressing coil springs 50. This additional movement forces upper bending bar 54 to bend the end of electrical leads 12 against lower bending bar 34 forming step 40, as shown in FIGS. 3 and 7. At this position of the jaws latch 60 has been slightly pivotted, but cutting bar 74 remains in an inoperative position by pin 64 engaging slot 70 in latch 60 and the handles cannot be squeezed further together to perform the cutting operation, as shown in FIG. 6.

Figure 9:
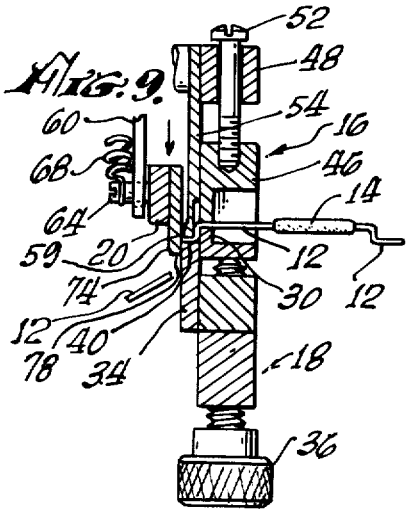

In order to release cutting bar 74 to perform its cutting operation, it is necessary for the operator to pull back on the upper end of latch 60 with his free hand to align pin 64 with slot 66. This movement releases the handles to be further squeezed together enabling cutting bar 74 to trim off the excess length of electrical lead 12, as clearly shown in FIG. 9.

When handles 20 and 22 are released to remove the flat-pack, the tension in spring 68 causes pin 64 to be returned to locking slot 70 in readiness for the next use of the tool.

The novel tool is readily portable and of a size that will fit into the average tool box or drawer. It enables the electrical leads to be bent and trimmed by the operator in sequential operations, while being clamped to prevent movement. All such operations can be performed by the operator quickly and accurately without the need to release the tool being held in one hand, enabling his free hand to initially support the module until it is clamped in position and subsequently to operate latch 60.

Obviously many modifications and variations of the present invention are possible in the light of the above teachings. It is therefore to be understood that within the scope of the appended claims the invention may be practiced otherwise than as specifically described.

I claim:

1. A portable scissor-like tool comprising:

a pair of jaws each having a handle for working an article positioned therebetween;

said jaws being open at one side to laterally receive the article therebetween;

means for mounting said jaws for movement in parallel relationship to each other;

each of said jaws having opposing clamping members for first gripping the article when the handles are initially squeezed together;

each of said jaws having opposing bending members for bending an end of the clamped article protruding beyond said clamping members upon further squeezing of the handle;

a cutting member mounted on one of said handles adjacent a corresponding jaw;

an actuating member resiliently connected to one of said jaws for applying pressure to the respective clamping member of said one jaw adjacent the cutting member;

a manually operable pivotal link connecting said actuating member to said handle;

said pivotal link being releasable from said actuating member to enable the handles to be further squeezed together and the cutting member moved relative to the actuating member for trimming off any portion of the article extending beyond the bending members.

2. The tool of claim 1 wherein said mounting means comprises one end each of a pair of spaced aligning pins anchored to the clamping member of one jaw with the other pin ends slidably mounted through the clamping member of the other jaw and said actuating member.

3. The tool of claim 1 wherein said pivotal link is provided with a slot for receiving a pin mounted on said handle; said slot having an offset locking portion locking the actuating member to said handle, and said link being manually pivotted by the operator to unlock the link to allow said handle to move independent of the actuating member to perform the cutting operation.

4. The tool of claim 2 wherein the clamping member of said other jaw is adjustable with its respective bending member for varying the depth of the bend in the workpiece.

* * * * *